US007004734B2

(12) United States Patent
Izawa et al.

(10) Patent No.: US 7,004,734 B2
(45) Date of Patent: Feb. 28, 2006

(54) RECIPROCATING REFRIGERANT COMPRESSOR

(75) Inventors: Ryosuke Izawa, Osato-gun (JP); Minoru Kanaizuka, Osato-gun (JP); Katsuhiko Arai, Osato-gun (JP); Katsumi Sakamoto, Osato-gun (JP)

(73) Assignee: Zexel Valco Climate Control Corporation, Saitama (JP)

( * ) Notice: Subject to any disclaimer, the term of this patent is extended or adjusted under 35 U.S.C. 154(b) by 294 days.

(21) Appl. No.: 10/466,045

(22) PCT Filed: Jan. 15, 2001

(86) PCT No.: PCT/JP01/00189

§ 371 (c)(1),
(2), (4) Date: Jul. 11, 2003

(87) PCT Pub. No.: WO02/055879

PCT Pub. Date: Jul. 18, 2002

(65) Prior Publication Data

US 2004/0076535 A1 Apr. 22, 2004

(51) Int. Cl.
*F04B 39/10* (2006.01)
*F04B 53/10* (2006.01)

(52) U.S. Cl. ..... 417/569; 417/222.2; 137/512.15

(58) Field of Classification Search ..... 417/559, 417/269, 222.2; 137/512.15, 516.13, 516.11
See application file for complete search history.

(56) References Cited

U.S. PATENT DOCUMENTS 4,652,217 A * 3/1987 Shibuya ..... 417/269
4,781,540 A * 11/1988 Ikeda et al. ..... 417/269
4,911,614 A * 3/1990 Kawai et al. ..... 417/269
4,951,706 A * 8/1990 Kardos ..... 137/512.1
5,074,768 A * 12/1991 Kawamura et al. ..... 417/571
5,242,276 A * 9/1993 Shimizu ..... 417/269
5,709,535 A * 1/1998 Enomoto et al. ..... 417/269
5,857,839 A * 1/1999 Fisher et al. ..... 417/269
6,022,199 A * 2/2000 Yoshii et al. ..... 417/269
6,293,768 B1 * 9/2001 Shintoku et al. ..... 417/312
6,382,927 B1 * 5/2002 Sonobe et al. ..... 417/269
6,402,483 B1 * 6/2002 Kawamura et al. ..... 417/269
6,767,193 B1 * 7/2004 Hirose et al. ..... 417/269
6,837,695 B1 * 1/2005 Une et al. ..... 417/571
6,912,948 B1 * 7/2005 Iizuka ..... 92/71
2002/0031435 A1 * 3/2002 Kawamura et al. ..... 417/269
2002/0067993 A1 * 6/2002 Harte et al. ..... 417/222.1
2002/0168272 A1 * 11/2002 Fujii et al. ..... 417/254
2002/0176786 A1 * 11/2002 Hirose et al. ..... 417/269
2004/0202553 A1 * 10/2004 Iizuka ..... 417/269

(Continued)

FOREIGN PATENT DOCUMENTS

JP 10-176669 A1 6/1998

(Continued)

*Primary Examiner*—William H. Rodriguez
(74) *Attorney, Agent, or Firm*—Rader, Fishman & Grauer PLLC

(57) ABSTRACT

An inlet port 15 is divided into a plurality of holes 15*a,* 15*b,* 15*c,* 15 by ribs 61*a,* 61*b,* 61*c*. For example, when liquid refrigerant is compressed within a compression chamber, the inlet valve 21 receives excessive load which is about to bend the inlet valve 21 largely toward the suction chamber side. However, the inlet valve 21 is supported by the ribs 61*a,* 61*b,* 61*c,* and therefore the inlet valve 21 is hardly bent, but the inlet port 21 is positively closed.

4 Claims, 12 Drawing Sheets

U.S. PATENT DOCUMENTS

2004/0247455 A1 * 12/2004 Kimoto et al. ..... 417/269
2005/0025648 A1 * 2/2005 Shimizu et al. ..... 417/521
2005/0031477 A1 * 2/2005 Hibino et al. ..... 417/559
2005/0169769 A1 * 8/2005 Kanai ..... 417/269
2005/0175470 A1 * 8/2005 Terauchi ..... 417/269
2005/0186087 A1 * 8/2005 Koide et al. ..... 417/269

FOREIGN PATENT DOCUMENTS

JP 10-196536 A1 7/1998
JP 2000-18160 A1 1/2000

* cited by examiner

PRIOR ART

RECIPROCATING REFRIGERANT COMPRESSOR

TECHNICAL FIELD

This invention relates to a reciprocating refrigerant compressor used as a refrigerant compressor for an automotive air conditioner, and more particularly to a reciprocating refrigerant compressor of a type in which pistons reciprocate, such as a wobble plate compressor and a swash plate compressor.

BACKGROUND ART

A wobble plate compressor includes a cylinder block having a plurality of cylinder bores, a plurality of pistons for reciprocating within the respective cylinder bores, a cylinder head secured to an end face of the cylinder block via a valve plate, and a plurality of inlet valves for opening and closing a plurality of inlet ports formed through the valve plate.

Within the cylinders are formed compression chambers, respectively, and the volume of each compression chamber varies with the motion of a piston associated therewith.

The cylinder head has a suction chamber formed therein for receiving low-pressure refrigerant gas flowing therein from an evaporator side.

The number of the inlet valves and the number of the inlet ports formed through the valve plate are equal to the number of the cylinder bores, similarly to the number of the compression chambers and the number of the pistons.

The suction chamber communicates with the compression chambers via the inlet ports.

During the suction stroke, as the volume of a compression chamber progressively increases, the inlet valve is bent toward the compression chamber side to open the inlet port, via which refrigerant gas in the suction chamber is drawn into the compression chamber.

FIG. 12 is a fragmentary enlarged plan view of a valve plate of a conventional wobble plate compressor.

A valve plate 702 is formed with inlet ports 715, and outlet ports 716 are formed inward of the inlet ports 715 (radially inward in the valve plate 702). Further, the inlet ports 715 and the outlet ports 716 are located inward of respective opening edges 706*a* of the cylinder bores. An inlet valve 721 is formed with a hole 763, such that the outlet port 716 is prevented from being closed by the inlet valve 721.

The opening edge 706*a* of the cylinder bore is formed with a stopper recess 770 at a location opposed to an end portion 721*a* of the inlet valve 721.

As the piston moves toward the bottom dead center position during the suction stroke, the difference in pressure between the compression chamber and the suction chamber is increased, whereby the inlet valve 721 is bent toward the compression chamber side to open the inlet port 715, via which refrigerant gas in the suction chamber is drawn into the compression chamber. At this time, the end portion 721*a* of the inlet valve 721 abuts on the stopper recess 770, which limits the bend of the inlet valve 721.

The dimension of depth of the stopper recess 770 (length from an end face of the cylinder block to the bottom surface of the stopper recess 770) is configured to be small to thereby reduce the suction pulsation.

As the piston moves toward the top dead center position during the compression stroke, the volume of the compression chamber is progressively reduced to increase the pressure in the compression chamber. At this time, the inlet valve 721 is brought into intimate contact with the valve plate 702 by high pressure to close the inlet port 715.

However, if the dimension of depth of the stopper recess 770 is small, the suction efficiency is lowered, which degrades the performance of the refrigerant compressor.

To improve the performance of the refrigerant compressor, it is necessary to increase the area of an opening formed during suction of refrigerant. To meet this requirement, it is necessary to increase the area of the inlet port 715. If the area of the inlet port 715 is increased, it is necessary to enlarge the inlet valve 721 accordingly.

However, if the area of the inlet port 715 is increased, during liquid compression in which liquid (liquid refrigerant) is compressed within the compression chamber, excessive load is applied to the inlet valve 721, which sometimes causes leakage of the liquid into the suction chamber side, or deformation or breakage of the inlet valve 721.

It is an object of the invention to provide a reciprocating refrigerant compressor that is capable of increasing the ar as of inlet ports, and at the same time preventing leakage of liquid into the suction chamber side and deformation and breakage of inlet valves.

DISCLOSURE OF THE INVENTION

To attain the above object, a reciprocating refrigerant compressor according the present invention includes a cylinder block having a plurality of cylinder bores formed therein, a cylinder head secured to an end face of the cylinder block via a valve plate, a low-pressure chamber formed within the cylinder head, a plurality of inlet ports formed through the valve plate, for communicating between the low-pressure chamber and the cylinder bores, and a plurality of inlet valves for opening and closing the inlet ports, a number of the inlet ports and a number of the inlet valves being both equal to a number of the cylinder bores, wherein the inlet ports are each divided into a plurality of holes by ribs.

For example, when liquid is compressed within a compression chamber, excessive load is applied during the compression stroke to an inlet valve whereby the inlet valve is about to be largely bent toward the suction chamber side. However, the inlet valve is supported by the ribs, which restricts excessive bend of the inlet valve. Therefore, even when the area of the inlet port is increased, it is possible to prevent leakage of liquid refrigerant into the suction chamber side, and deformation and breakage of the inlet valve.

Preferably the ribs are formed substantially radially from a central axis of the cylinder bore.

Since the ribs are formed substantially radially from a central axis of the cylinder bore, as describe above, the ribs do not offer significant resistance to the refrigerant gas, so that the inflow of refrigerant gas becomes smooth.

Preferably, the ribs have a surface formed with a groove or a hole.

Since the ribs have a surface formed with a groove or a hole, as described above, lubricating oil collected between the inlet valve and the valve plate is discharged via the grooves or the holes. Therefore, it is possible to prevent delay of timing in which the inlet valve opens during the suction stroke.

Preferably, the ribs are formed substantially radially from a central axis of the cylinder bore, and the ribs have a surface formed with a groove or a hole.

BEST MODE FOR CARRYING OUT THE INVENTION

The invention will now be described in detail with reference to drawings showing preferred embodiments thereof.

Figure 1:
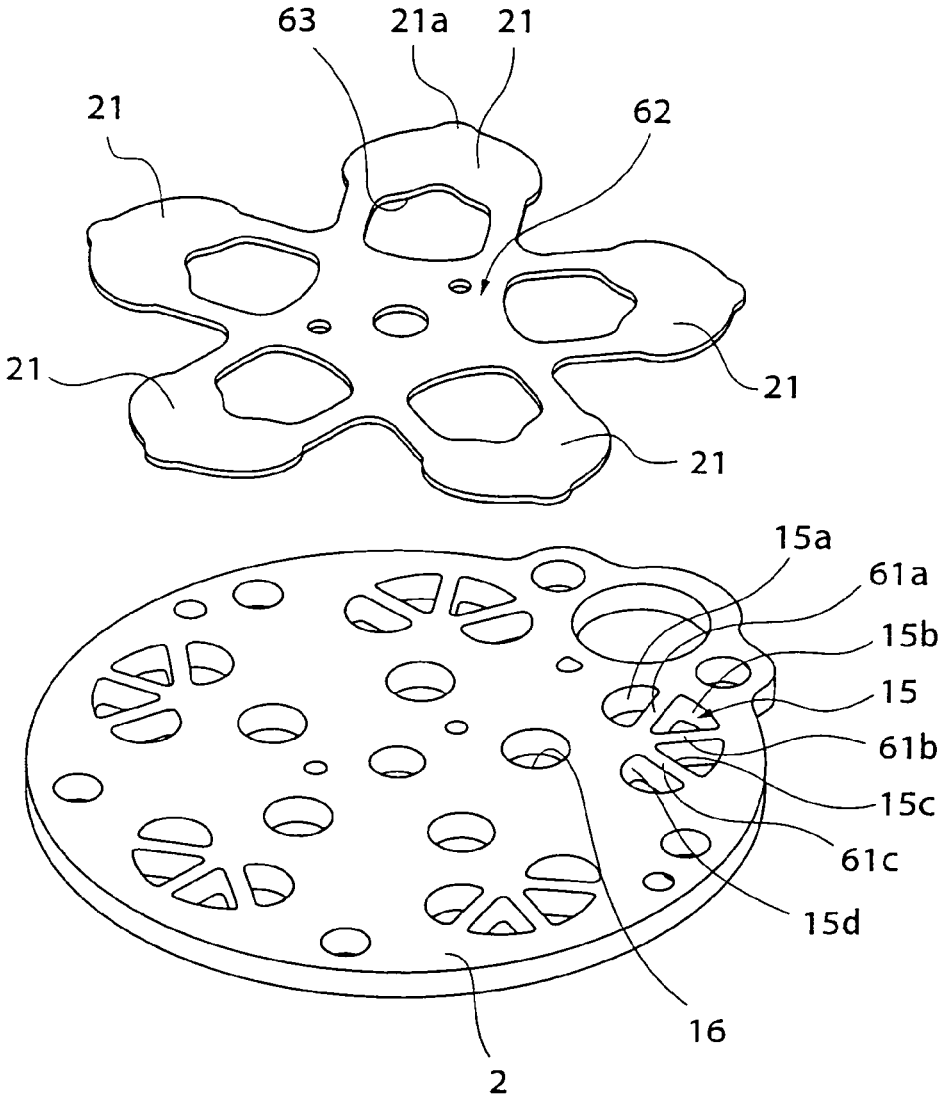
FIG. 1 is a perspective view showing a valve plate and a valve sheet of a wobble plate compressor according to a first embodiment of the present invention.
Figure 2:
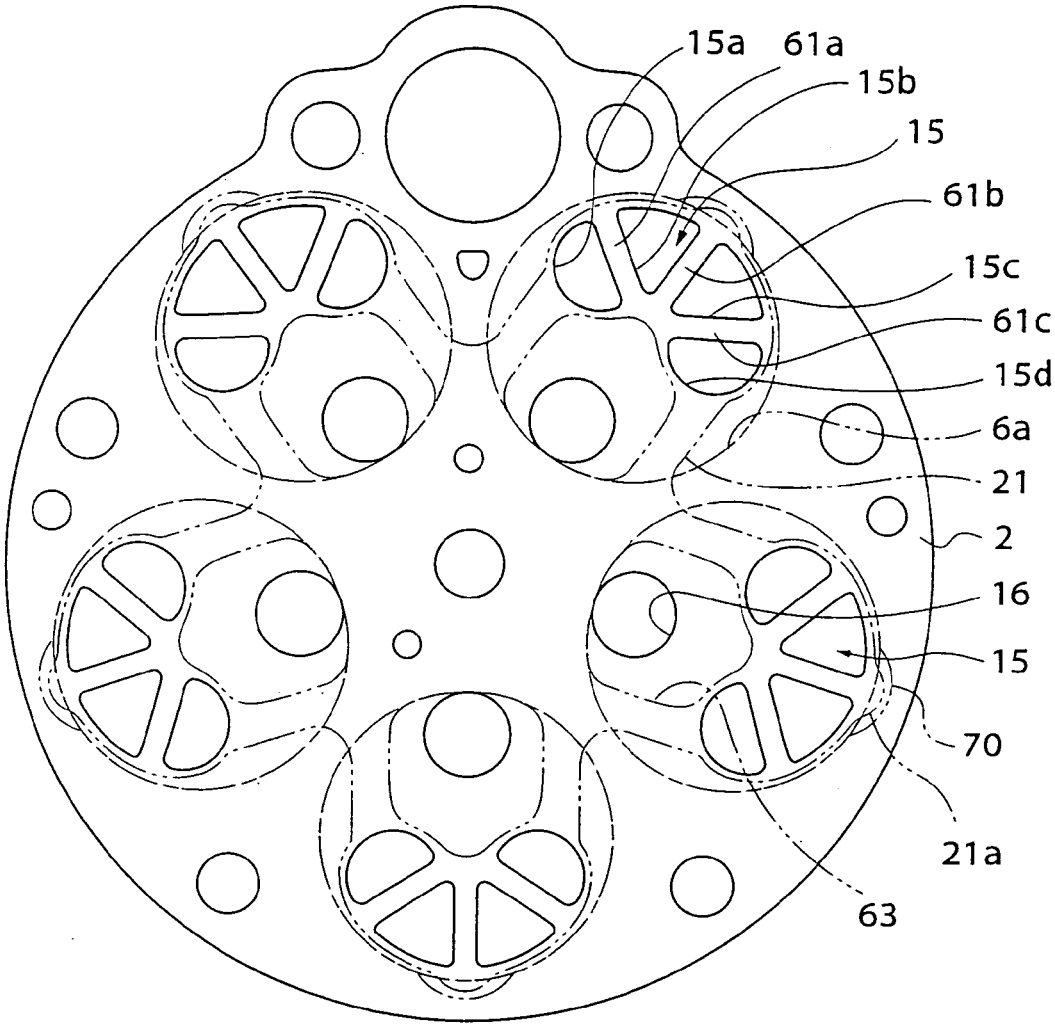
FIG. 2 is a plan view of the valve plate shown in FIG. 1.
Figure 3:
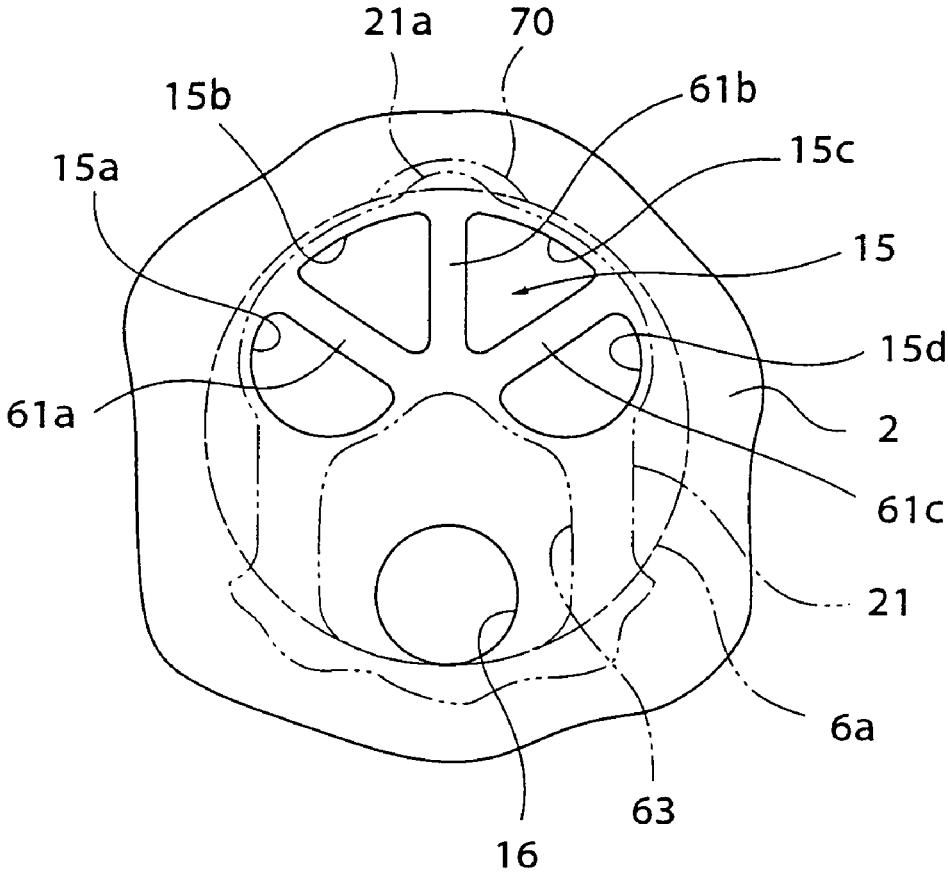
FIG. 3 is a fragmentary enlarged view of the valve plate shown in FIG. 2.
Figure 4:
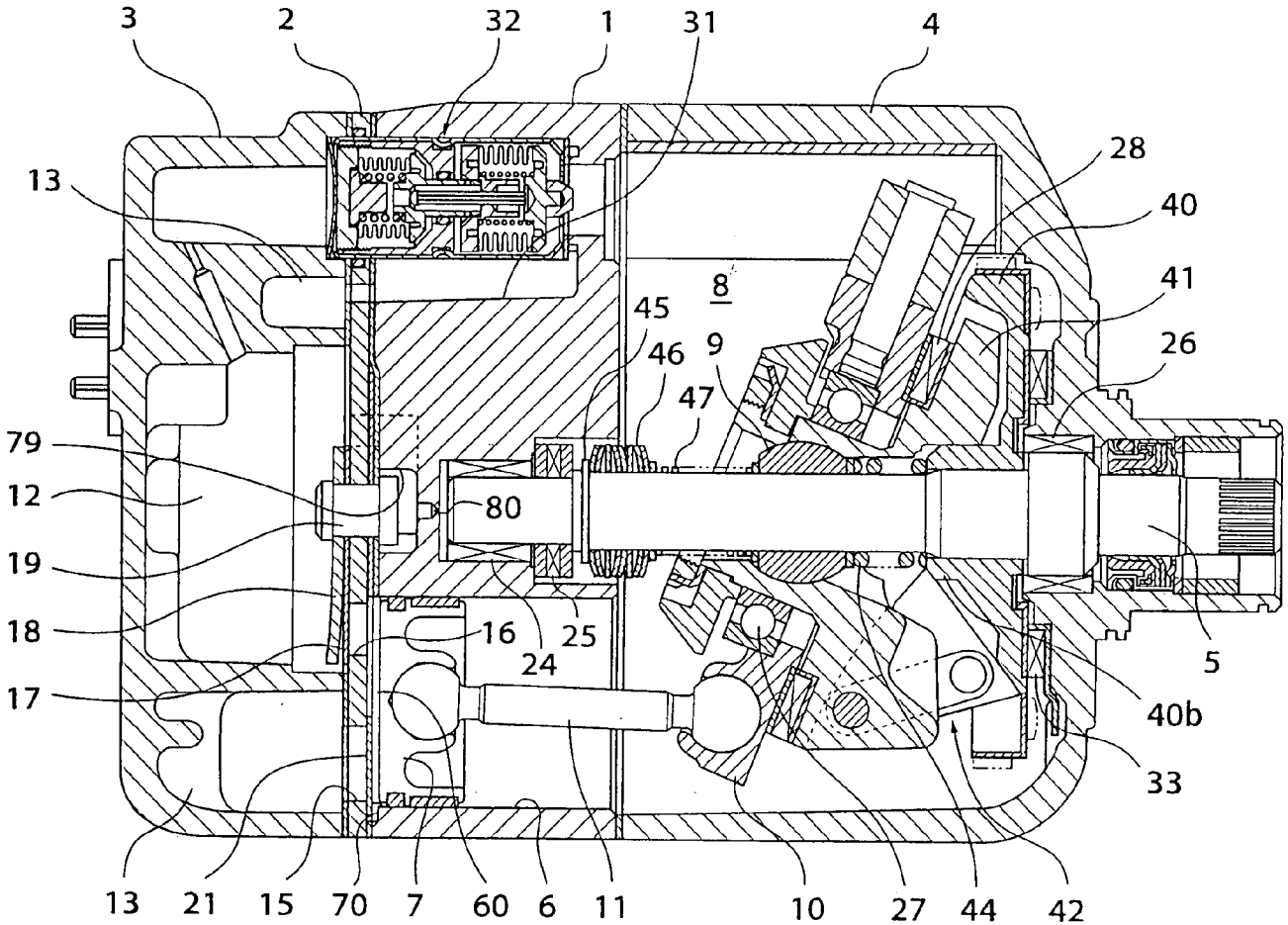
FIG. 4 is a longitudinal cross-sectional view of a wobble plate compressor according to the first embodiment of the present invention.

FIG. 4 is a longitudinal cross-sectional view of a wobble plate compressor according to a first embodiment of the invention. FIG. 1 is a perspective view showing a valve plate and a valve sheet of the wobble plate compressor. FIG. 2 is a plan view of the valve plate shown in FIG. 1, and FIG. 3 is a fragmentary enlarged view of the valve plate shown in FIG. 2.

This compressor has a cylinder block 1 having one nd thereof secured to a rear head (cylinder head) 3 via a valve plate 2 and the other end thereof secured to a front head 4.

The cylinder block 1 has a plurality of cylinder bores 6 axially extending therethrough at predetermined circumferential intervals about the shaft 5. Each cylinder bore 6 has a piston 7 slidably received therein. The cylinder bore 6 defines a compression chamber 60 therein, the volume of which is changed with motion of the piston 7. An opening edge 6*a* of the cylinder bore 6 is formed with a stopper recess 70, at a location opposed to an end portion 21*a* of an inlet valve 21, for limiting the bend of the end portion 21*a* of the inlet valve 21 (see FIGS. 2 and 3). The stopper recess 70 limits the amount of bend (opening degree) of the inlet valve 21.

Within the front head 4, there is formed a crankcase 8 within which a wobble plate 10 is accommodated for performing wobbling motion about a hinge ball 9 in a manner interlocked with the rotation of the shaft 5.

Within the rear head 3, there are formed a discharge chamber 12 and a suction chamber 13 located around the discharge chamber 12.

The valve plate 2 is formed with a plurality of outlet ports 16 for communicating between the cylinder bores 6 and the discharge chamber 12, and a plurality of inlet ports 15 for communicating between the cylinder bores 6 and the suction chamber 13, at predetermined circumferential intervals. The outlet ports 16 are opened and closed by the outlet valves 17, and the outlet valves 17 are fixed to the rear head-side end face of the valve plate 2 together with a valve retainer 18 by a rivet 19. Further, the inlet ports 15 are opened and closed by the inlet valves 21, and the inlet valves 21 are disposed between the valve plate 2 and the cylinder block 1. The discharge chamber 12 and the crankcase 8 are communicated with each other via a passage 79 and an orifice 80.

The respective numbers of the inlet valves 21, the outlet valves 17, the inlet ports 15, the outlet ports 16, and the compression chambers 60 are equal to the number (5 in this embodiment) of the cylinder bores 6.

Figure 12:
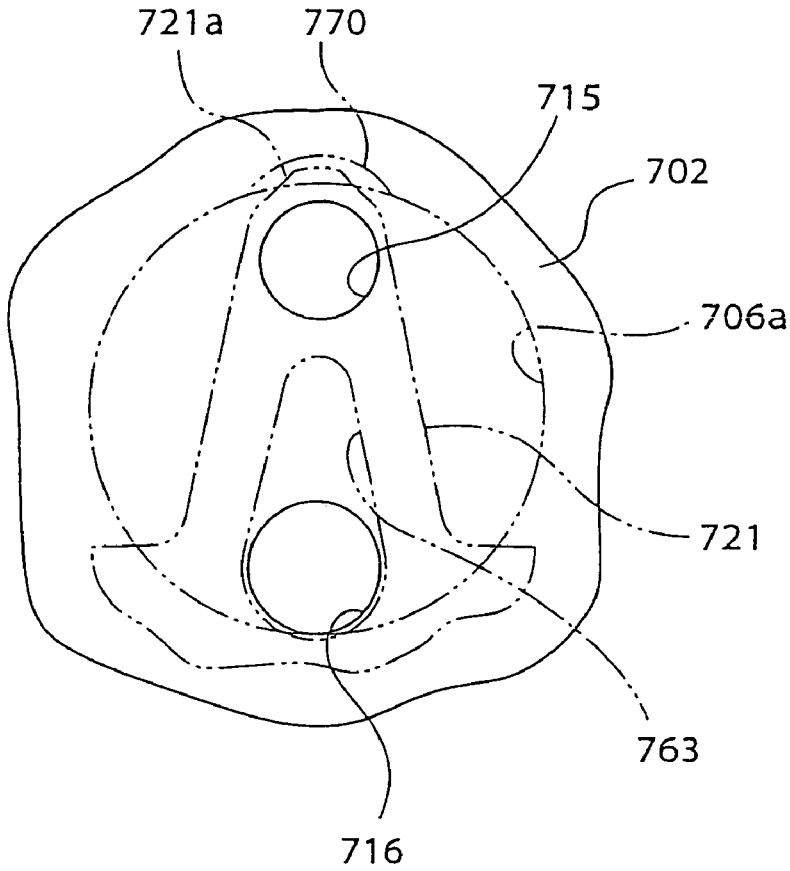
FIG. 12 is a fragmentary enlarged plan view of a valve plate of a conventional wobble plate compressor.

As shown in FIGS. 1 and 2, the inlet ports 15 and the outlet ports 16 are located, inward of the opening edges 6*a* of the cylinder bores 6, respectively. Further, the inlet ports 15 are located outward of the outlet ports 61 (radially outward in the valve plate 2). The five inlet ports 15 are each formed by a plurality of holes 15*a*, 15*b*, 15*c*, 15*d*. In other words, the holes 15*a*, 15*b*, 15*c*, 15*d* form one inlet port 15. The sum total of respective areas of the holes 15*a*, 15*b*, 15*c*, 15*d* forming one inlet port 15 is larger than the area of the inlet port 715 of the prior art (see FIGS. 3 and 12). In accordance therewith, the end portion 21*a* of the inlet valve 21 is larger than the end portion 721*a* of the inlet valve 721 of the prior art.

The holes 15*a*, 15*d* are generally semi-circular, and the holes 15*b*, 15*c* are generally sector-shaped. The holes 15*a*, 15*b*, 15*c*, 15*d* are arranged along the opening edge 6*a* of the cylinder bore 6. The holes 15*a* and 15*b*, the holes 15*b* and 15*c*, and the holes 15*c* and 15*d* are adjacent to each other via ribs 61*a*, 61*b*, 61*c*, respectively.

As shown is FIG. 1, the five inlet valves 21 are integrally formed with a valve sheet 62. Each inlet valve 21 is form d with a hole 63, which prevents the outlet port 16 from being closed by the inlet valve 21.

The cylinder block 1 is formed with a communication passage 31 communicating between the suction chamber 13 and the crankcase 8, and a pressure control valve 32 is arranged across an intermediate portion of the communication passage 31, for control of pressure in the suction chamber 13 and pressure in the crankcase 8.

Further, the front-side end of the shaft 5 is rotatably supported by a radial bearing 26 arranged in the front head 4, and the rear-side end of the shaft 5 is rotatably supported by a radial bearing 24 and a thrust bearing 25. The shaft 5 has a thrust flange 40 fixed thereon, and a drive hub 41 mounted thereon via the hinge ball 9 which is axially slidable. The thrust flange 40 is supported on the inner wall of the front head 4 via a thrust bearing 33. A portion of the thrust flange 40 and a portion of the drive hub 41 are connected by a linkage 42 via which the rotation of the shaft 5 is transmitted from the thrust flange 40 to the drive hub 41. The wobble plate 40 is relatively rotatably mounted on the drive hub 41 via a radial bearing 27 and a thrust bearing 28. The wobble plate 10 is connected to the pistons via connecting rods 11.

Between the hinge ball 9 and a boss 40 of the thrust flange 40, a coil spring 44 is interposed as a destroke spring, and the hinge ball 9 is urged toward the cylinder block 1 by the coil spring 44.

Further, a fixed washer 45 is fixedly fitted on the shaft 5 at a location toward the cylinder block side, and between the fixed wash 45 and the hinge ball 9, a plurality of curved springs 46 and a coil spring 47 as destroke springs are interposed in series, for urging the hinge ball 9 toward the thrust flange 40.

Next, the operation of this wobble plate compressor will be described.

As torque of an engine, not shown, installed on a vehicle, not shown, is transmitted to the shaft 5, the thrust flange 40 and the drive hub 41 rotate together with the shaft 5, which causes the wobble plate 10 to perform wobbling motion about the hinge ball 9. The wobbling motion is transmitted to the pistons 7 via the connecting rods 11, whereby the wobbling motion is converted to the linear reciprocating motion of each piston 7. As the piston 7 reciprocates in the cylinder bore 6, the volume of the compression chamber 60 changes, which sequentially causes suction, compression, and delivery of refrigerant gas, whereby high-pressure refrigerant gas is delivered in an amount corresponding to an angle of inclination of the wobble plate 10.

When thermal load on the compressor decreases and the pressure control valve 32 closes the communication passage 31 to increase the pressure in the crankcase 8, the angle of inclination of the wobble plate 10 becomes smaller, so that the length of stroke of the piston 7 is decreased to reduce the displacement of the compressor. On the other hand, when thermal load on the compressor increases and the pressure control valve 32 opens the communication passage 31 to reduce the pressure in the crankcase 8, the angle of inclination of the wobble plate 10 becomes larger, whereby the length of stroke of the piston 7 is increased to increas the displacement of the compressor.

In the suction stroke, as the piston 7 moves to the bottom dead center position, the difference between pressure in the compression chamber 60 and pressure in the suction chamber 13 is increased, so that the inlet valve 21 is bent into the compression chamber 60 to open the inlet port 15, via which the refrigerant gas in the suction chamber 13 is drawn into the compression chamber 60. As described above, the five inlet ports 15 are each comprised of a plurality of holes 15*a* to 15*d*, and the sum total of the respective areas of the holes 15*a* to 15*d* is larger than the area of the inlet port 715 of the prior art, which makes the suction efficiency higher than the prior art to improve the performance of the refrigerant compressor. Further, the flow of refrigerant gas drawn in is rectified (this is also the case with a third embodiment of the invention).

Further, in the compression stroke, as the piston 7 moves to the top dead center position, the volume of the compression chamber 60 is progressively reduced to increase the pressure in the compression chamber 60. At this time, the inlet valve 21 keeps the inlet port 15 closed and the outlet valve 17 keeps the outlet port 16 closed. In the delivery stroke, the volume of the compression chamber 60 becomes minimum, and the pressure in the compression chamber 60 becomes maximum. When there is produced a predetermined differential pressure between the compression chamber 60 and the discharge chamber 12, the outlet valve 17 is bent into the discharge chamber 60 to open the outlet port 16. At this time, the inlet valve 21 keeps the inlet port 15 closed. At this time, the inlet valve is urged against the valve plate 2 by high pressure to keep the inlet port 15 closed.

Further, when liquid is compressed within the compression chamber 60, excessive load acting on the inlet valve 21 is about to largely bend the inlet valve 21 into the suction chamber 13. However, since the inlet valve 21 is supported by the ribs 61*a*, 61*b*, 61*c*, the bend is restricted, thereby ensuring the sealing properties.

According to the first embodiment, even when the area of the inlet port 15 is increased, it is possible to prevent leakage of liquid refrigerant into the suction chamber 13 and deformation and breakage of the inlet valve 21.

Figure 5:
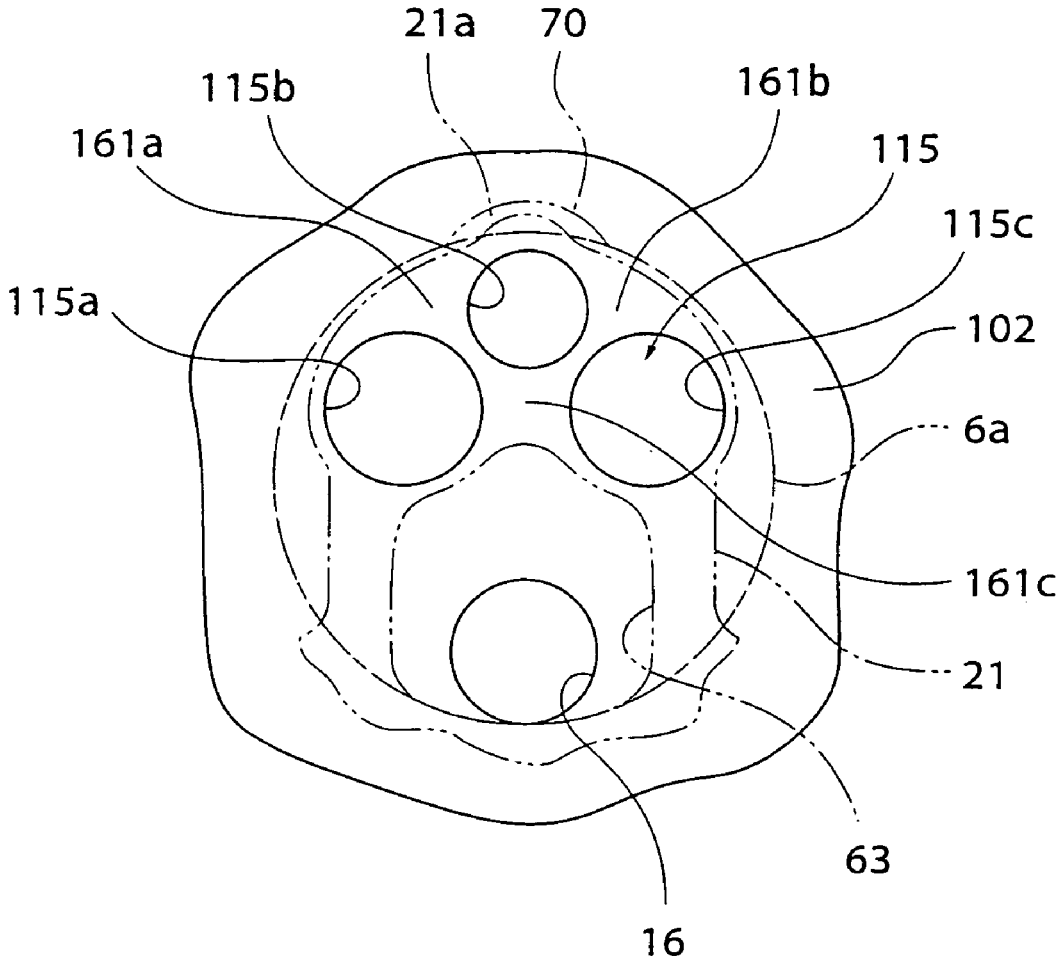
FIG. 5 is a fragmentary enlarged plan view of a valve plate of a wobble plate compressor according to a second embodiment of the present invention.

FIG. 5 is a fragmentary enlarged plan view of a valve plate of a wobble plate compressor according to a second embodiment of the present invention. The construction of the wobble plate compressor is identical to that of the wobble plate compressor according to the first embodiment except for the valve plate, and therefore description thereof is omitted.

In this embodiment, five inlet ports 115 of the valve plate 102 are each formed by three holes 115*a*, 115*b*, 115*c*. The holes 115*a*, 115*b*, 115*c* are circular, and are easy to machine. The areas of the holes 115*a*, 115*c* are approximately equal to each other, and the area of the hole 115*b* is smaller than that of the hole 115*a*. The holes 115*a* and 115*b*, the holes 115*b* and 115*c*, the holes 115*a* and 115*c* are adjacent to each other via ribs 161*a*, 161*b*, 161*c*, respectively.

The second embodiment provides the same advantageous effects as provided by the first embodiment.

Figure 6:
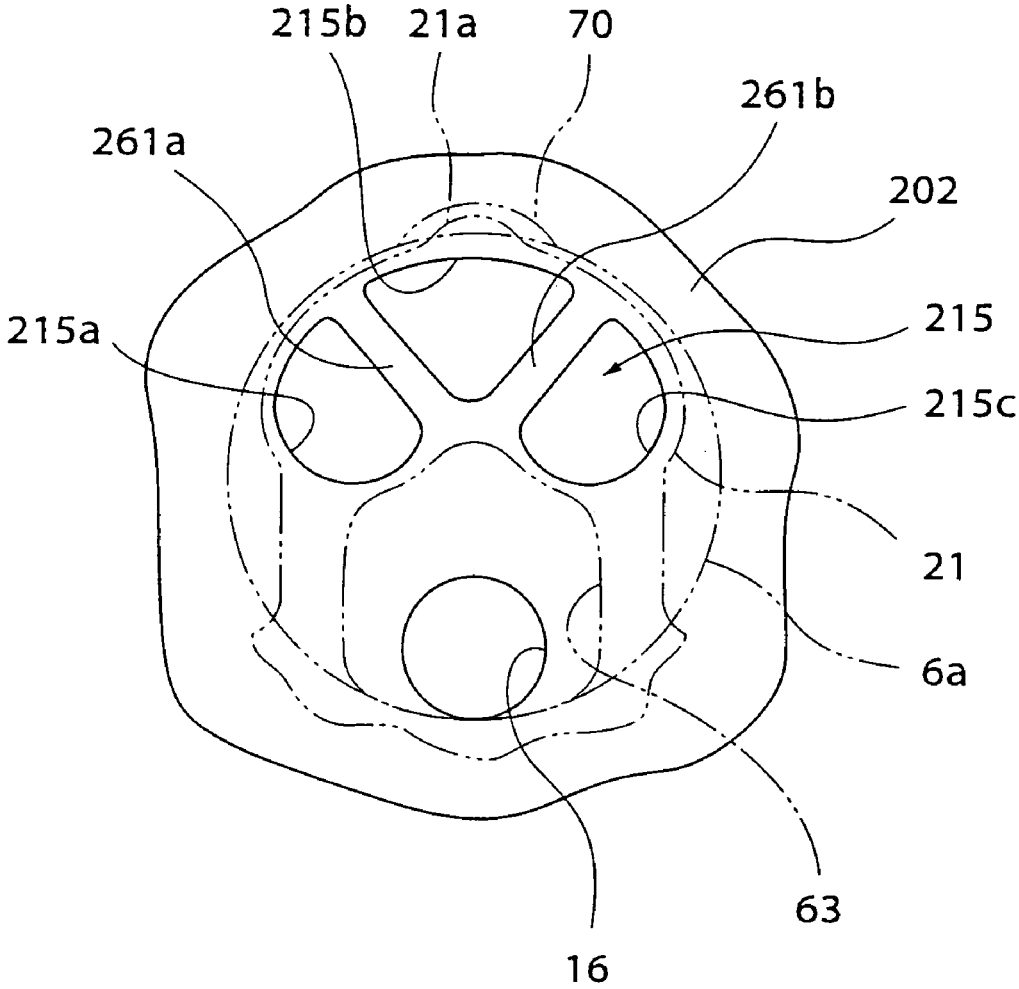
FIG. 6 is a fragmentary enlarged plan view of a valve plate of a wobble plate compressor according to a third embodiment of the present invention.

FIG. 6 is a fragmentary enlarged plan view of a valve plate of a wobble plate compressor according to a third embodiment of the present invention. The construction of the wobble plate compressor is identical to that of the wobble plate compressor according to the first embodiment except for the valve plate, and therefore description thereof is omitted.

In this embodiment, five inlet ports 215 of the valve plate 202 are each formed by three holes 215*a*, 215*b*, 215*c*. The holes 215*a*, 215*c* are generally semi-circular, and the hole 215*b* is generally sector-shaped. The holes 215*a* and 215*b*, and the holes 215*b* and 215*c* are adjacent to each other via ribs 261*a*, 261*b*, respectively.

The third embodiment provides the same advantageous effects as provided by the first embodiment.

It should be noted that the above embodiments have common features in that the inlet ports 15, 115, 215 are formed by respective pluralities of holes 15*a* to 15*d*, 115*a* to 115*c*, 215*a* to 215*c*, that a plurality of holes are arranged along the opening edge 6*a* of the cylinder bore 6, and that the sum total of respective areas of holes forming one inlet port is larger than the area of one inlet port 715 of the prior art (approximately three times larger).

Figure 7:
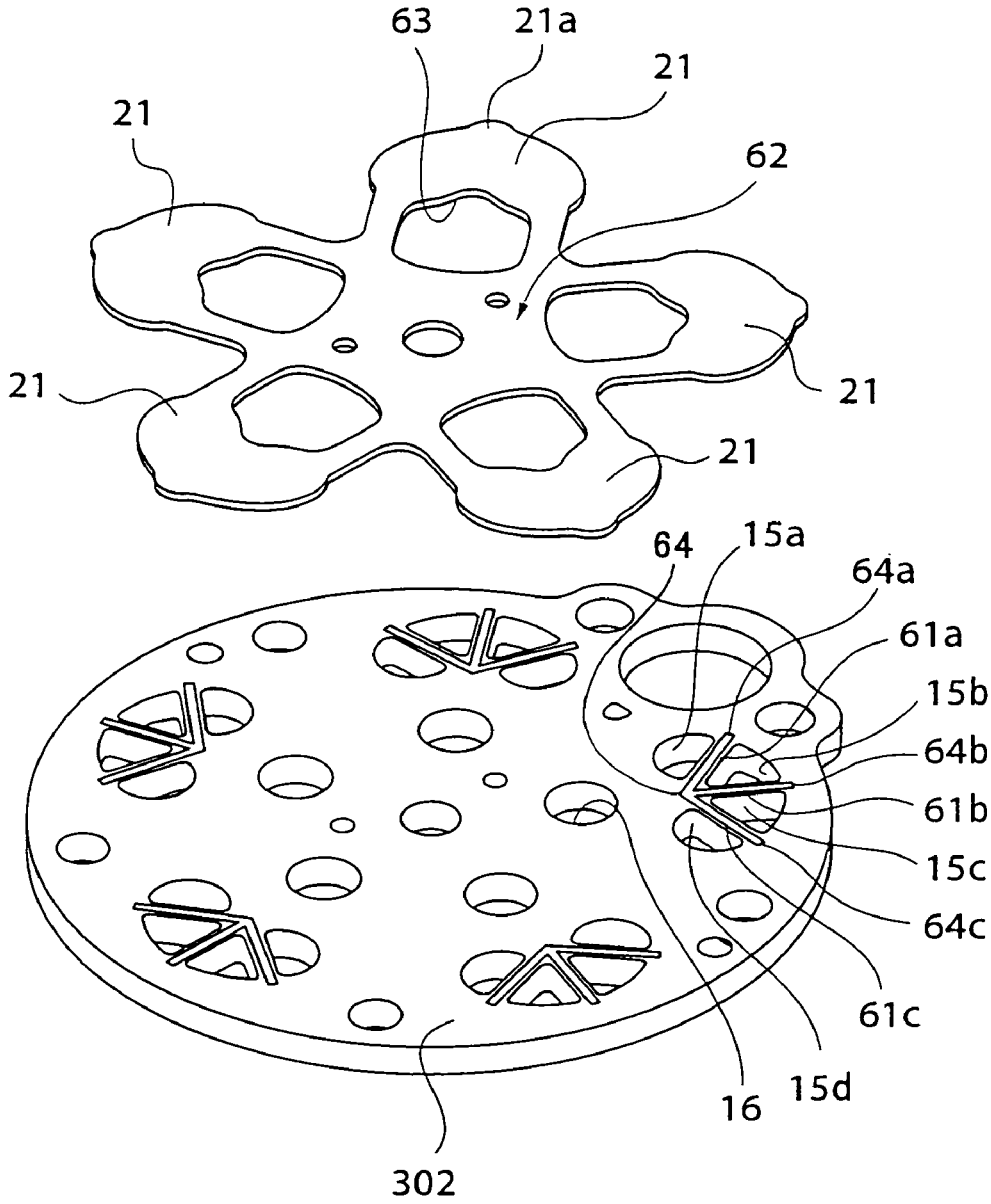
FIG. 7 is a perspective view showing a valve plate and a valve sheet of a wobble plate compressor according to a fourth embodiment of the present invention.
Figure 8:
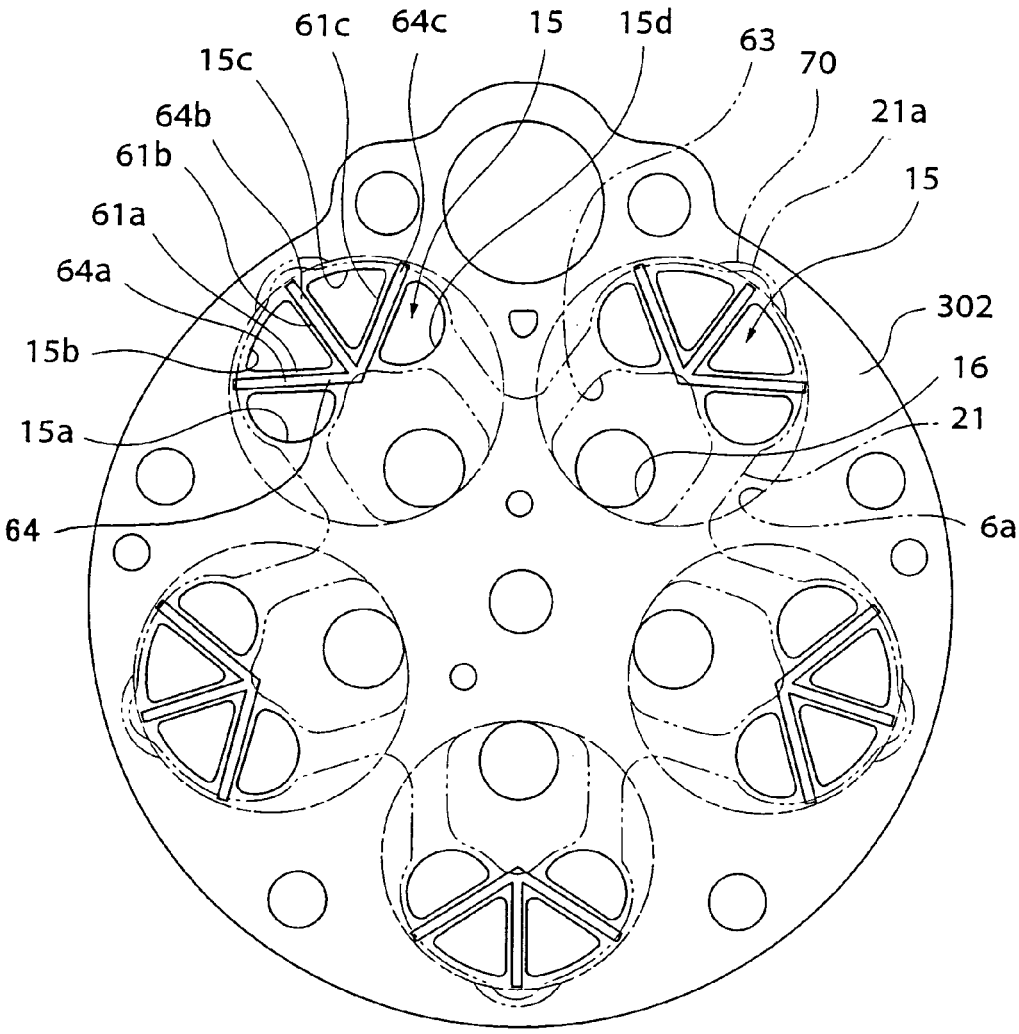
FIG. 8 is a plan view of the valve plate.

FIG. 7 is a perspective view showing a valve plate and a valve sheet of a wobble plate compressor according to a fourth embodiment of the present invention, and FIG. 8 is a plan view of the valve plate. The construction of this wobble plate compressor is identical to that of the wobble plate compressor according to the first embodiment except for the valve plate, and therefore description thereof is omitted.

The valve plate 302 of this embodiment has one linear groove (groove) 64 formed in each of the ribs 61*a*, 61*b*, 61*c* of the valve plate 2 of the first embodiment. In other words, the fourth embodiment has features in common with the first embodiment in that each inlet port 15 is formed by four holes 15*a* to 15*d*, and that the holes 15*a* and 15*b*, the holes 15*b* and 15*c*, and the holes 15*a* and 15*d* are adjacent to each other via the ribs 61*a*, 61*b*, 61*c*, respectively, but is different from the first embodiment in that the linear grooves 64 are formed in the respective surfaces of the ribs 61*a*, 61*b*, 61*c*.

When the inlet valve 21 is in intimate contact with the valve plate 2 to keep the inlet port 15 closed, lubricating oil collected between the inlet valve 21 and the valve plate 2 is discharged through the linear grooves 64.

Therefore, when a predetermined differential pressure is produced between the compression chamber 60 and the suction chamber 21 during the suction stroke, the inlet valve 21 rapidly opens. In this connection, without the linear grooves 64, the lubricating oil between the inlet valve 21 and the valve plate 2 causes the inlet valve 21 to be adsorbed toward the ribs 61*a*, 61*b*, 61*c*, which sometimes delays the timing in which the inlet valve 21 opens, thereby degrading the suction efficiency.

It should be noted that the linear grooves 64 are provided only in the ribs 61*a*, 61*b*, 61*c*, and therefore, seating properties of the inlet valve 21 on the valve plate 2 are not degraded by the linear grooves 64.

The fourth embodiment provides the same advantageous effects as provided by the first embodiment, and at the same time, due to capability of preventing delay of timing of opening of th inlet valves 21 in the suction stroke, it is possible to enhance the suction efficiency and improve the performance of the refrigerant compressor.

Figure 9:
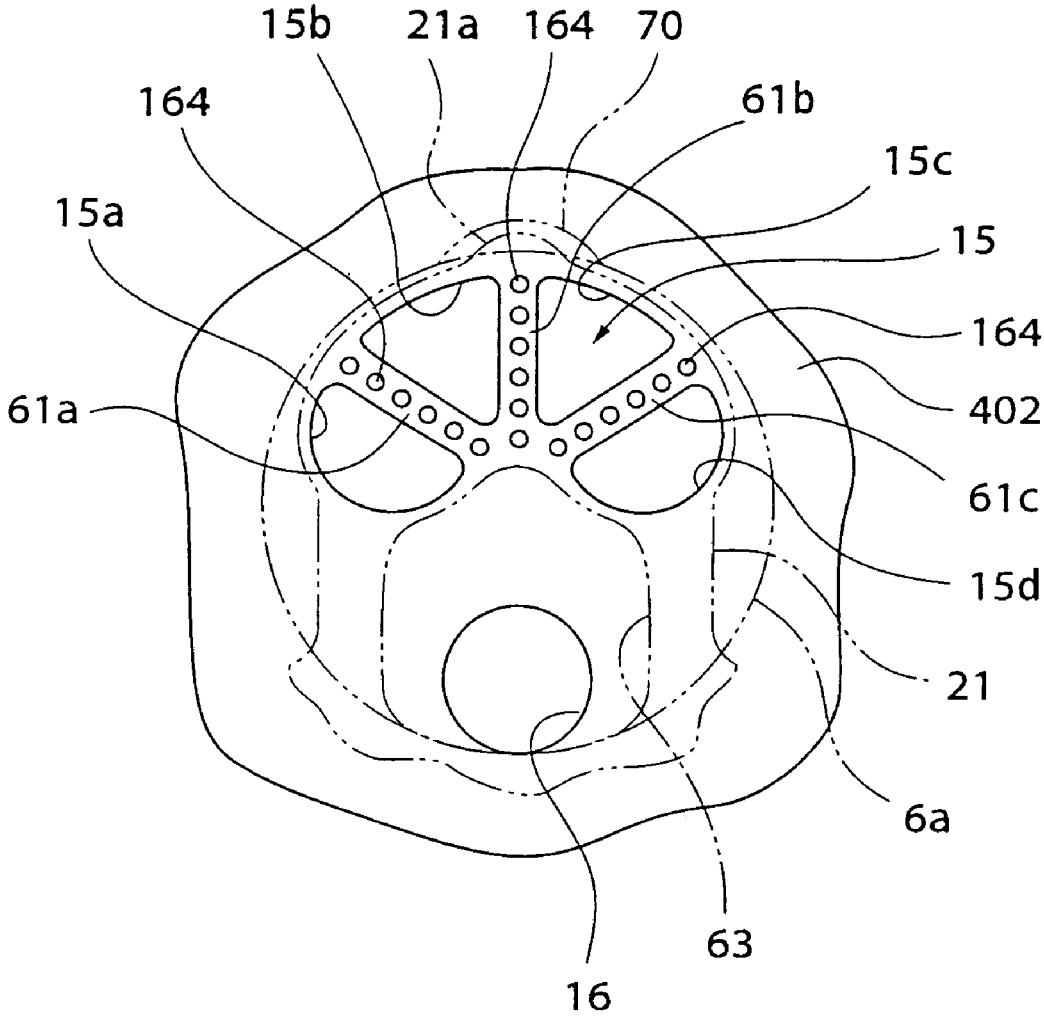
FIG. 9 is a fragmentary enlarged plan view of a valve plate of a wobble plate compressor according to a fifth embodiment of the present invention.

FIG. 9 is a fragmentary enlarged plan view of a valve plate of a wobble plate compressor according to a fifth embodiment of the present invention. The construction of this wobble plate compressor is identical to that of the wobble plate compressor according to the first embodiment except for the valve plate, and therefore description thereof is omitted.

The valve plate 402 of this embodiment has a plurality of round holes (holes) 164 linearly arranged in each of ribs 61*a*, 61*b*, 61*c* of the valve plate 2 of the first embodiment. In other words, the fifth embodiment has a feature in common with the first embodiment and the fourth embodiment in that each inlet port is formed by four holes 15*a* to 15*d*, and that the holes 15*a* and 15*b*, the holes 15*b* and 15*c*, and the holes 15*c* and 15*d* are adjacent to each other via the ribs 61*a*, 61*b*, 61*c*, respectively, but is different from the first embodiment and the fourth embodiment in that instead of the grooves 64*a*, 64*b*, 64*c*, a plurality of round holes 164 are formed in each of the ribs 61*a*, 61*b*, 61*c*.

The fifth embodiment provides the same advantageous effects as provided by the fourth embodiment.

Figure 10:
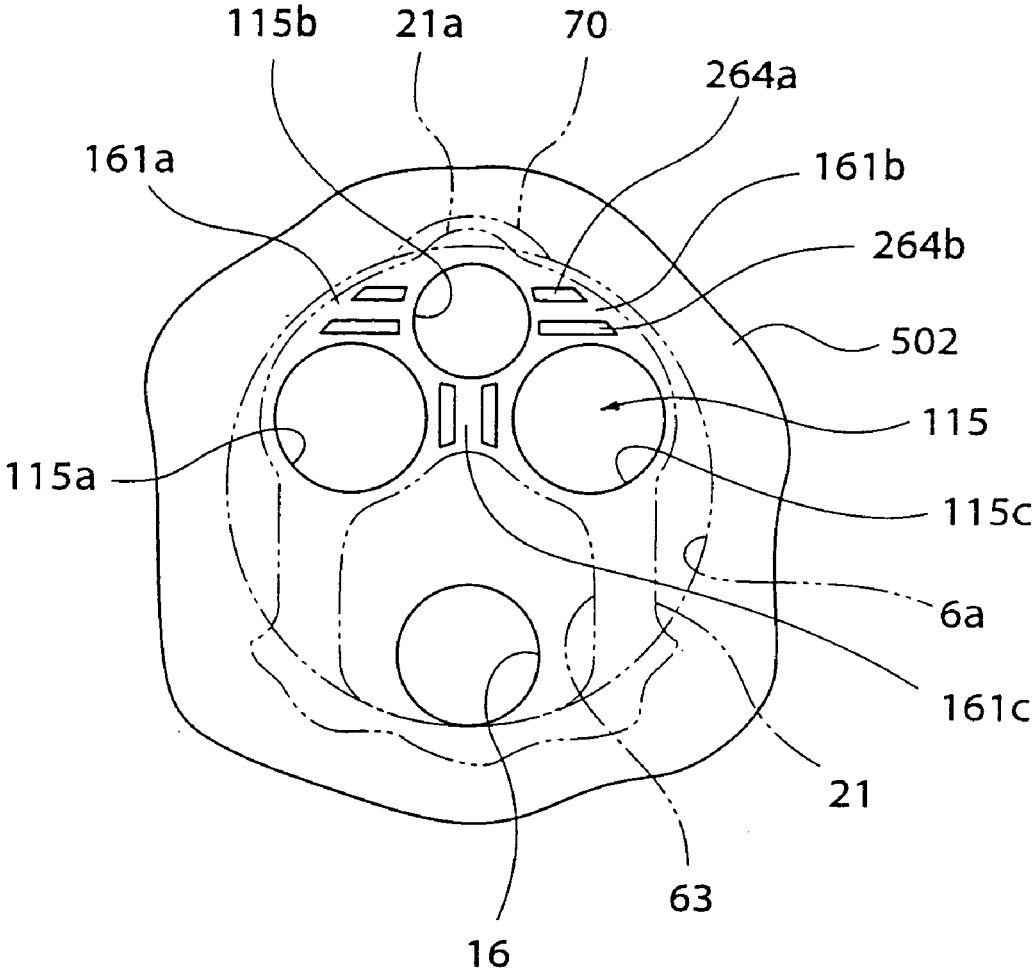
FIG. 10 is a fragmentary enlarged plan view of a valve plate of a wobble plate compressor according to a sixth embodiment of the present invention.

FIG. 10 is a fragmentary enlarged plan view of a valve plate of a wobble plate compressor according to a sixth embodiment of the present invention. The construction of this wobble plate compressor is identical to that of the wobble plate compressor according to the first embodiment except for the valve plate, and therefore description thereof is omitted.

The valve plate 502 of this embodiment has two linear grooves (grooves) 264*a*, 264*b* formed parallel to each other in each of the ribs 161*a*, 161*b*, 161*c* of the valve plate 102 of the second embodiment. In other words, the sixth embodiment has features in common with the third embodiment in that each inlet port 115 is formed by three holes 115*a* to 115*c*, and that the holes 115*a* and 115*b*, the holes 115*b* and 115*c*, the holes 115*c* and 115*a* are adjacent to each other via the ribs 161*a*, 161*b*, 161*c*, respectively, but is different from the second embodiment in that a plurality of linear grooves 264*a*, 264*b* are formed in each of the ribs 161*a*, 161*b*, 161*c*.

The sixth embodiment provides the same advantageous effects as provided by the fourth embodiment.

Figure 11:
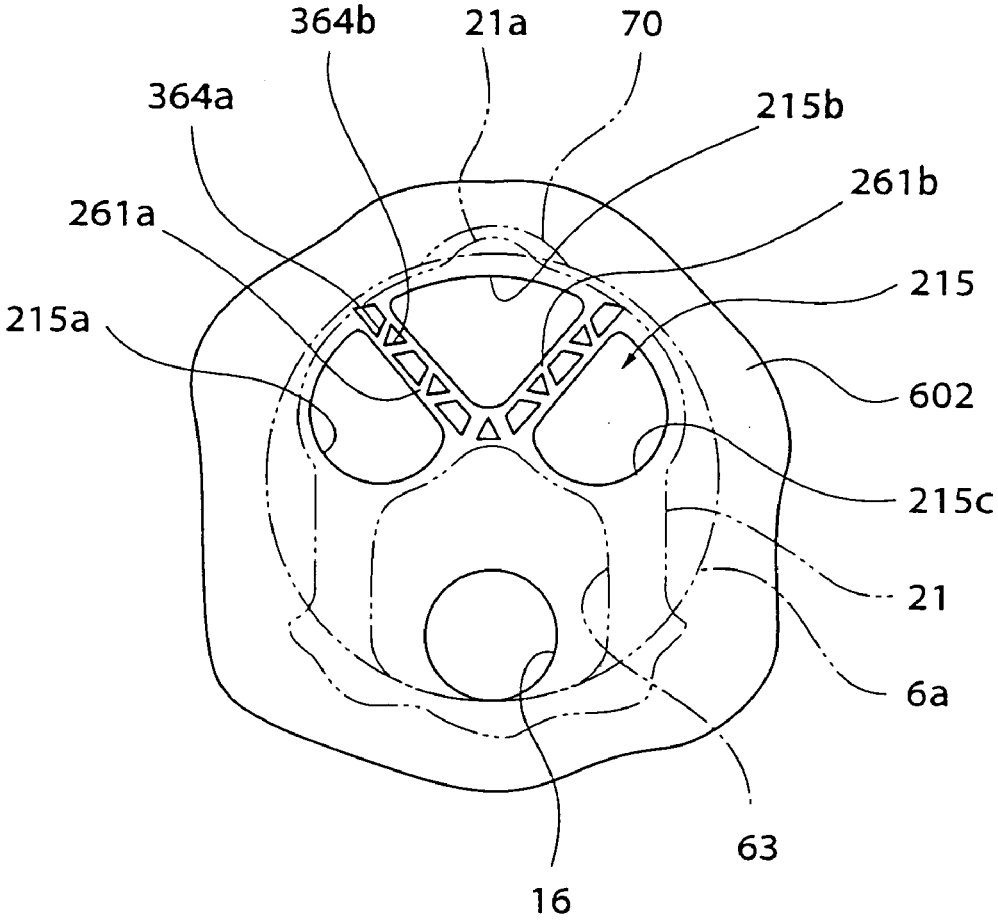
FIG. 11 is a fragmentary enlarged plan view of a valve plate of a wobble plate compressor according to a seventh embodiment of the present invention.

FIG. 11 is a fragmentary enlarged plan view of a valve plate of a wobble plate compressor according to a seventh embodiment of the present invention. The construction of this wobble plate compressor is identical to that of the wobble plate compressor according to the first embodiment except for the valve plate, and therefore description thereof is omitted.

The valve plate 602 of this embodiment has generally trapezoid-shaped holes 364*a* and generally triangular holes 364*b* formed in a line in an alternating manner in each of the ribs 261*a*, 261*b* of the valve plate 2 of the third embodiment. In other words, the seventh embodiment has features in common with the first embodiment in that each inlet port 215 is formed by three holes 215*a* to 215*c*, and that the holes 215*a* and 215*b*, and the holes 215*b* and 215*c* are adjacent to each other via the ribs 261*a*, 261*b*, respectively, but is different from the third embodiment in that the trap zoid-shaped holes 364*a* and the generally triangular holes 364*b* are arranged in a line in an alternating manner in each of the ribs 261*a*, 261*b*.

The seventh embodiment provides the same advantageous effects as provided by the fourth embodiment.

It should be noted that in the above embodiments, as the grooves and the holes, there are proposed by way of example, linear grooves 64, 264*a*, 264*b*, round holes 164, and polygonal holes (trapezoid-shaped holes 364*a* and triangular holes 364*b*), this is not limitative, but in stead of these, by increasing the surface roughness of the ribs 61*a* to 61*c*, 161*a* to 161*c*, 261*a*, 261*b* through spraying particles onto the surfaces thereof, it is also possible to realize the same function as offered by the holes and grooves.

Although in the above embodiments, as an example of the reciprocating refrigerant compressor, the wobble plate compressor is described, the scope of the present invention is not limited to this, but the present invention can be applied to other reciprocating compressors, such as a swash plate compressor.

INDUSTRIAL APPLICABILITY

As described heretofore, the reciprocating refrigerant compressor according to the present invention is useful as a refrigerant compressor for an automotive air conditioner, and according to this reciprocating refrigerant compressor, it is possible to increase the areas of inlet ports, and at the same time prevent leakage of liquid into the suction chamber and deformation and breakage of the inlet valves.

What is claimed is:

1. A reciprocating refrigerant compressor comprising:

a cylinder block having a plurality of cylinder bores formed therein;

a valve plate;

a cylinder head secured to an end face of said cylinder block via said valve plate;

a low-pressure chamber formed within said cylinder head;

a plurality of inlet ports formed through said valve plate, for communicating between said low-pressure chamber and said cylinder bores, a number of said inlet ports being equal to a number of said cylinder bores, said inlet ports each being divided into a plurality of holes by at least one rib; and a plurality of Inlet valves for opening and closing said inlet ports, a number of said inlet valves being equal to the number of said cylinder bores.

2. A reciprocating refrigerant compressor according to claim 1, wherein said at least one rib is formed substantially radially from a central axis of said cylinder bore.

3. A reciprocating refrigerant compressor according to claim 1, wherein said at least one rib has a surface formed with a groove or a hole.

4. A reciprocating refrigerant compressor according to claim 1, wherein said at least one rib is formed substantially radially from a central axis of said cylinder bore, and wherein said at least one rib has a surface formed with a groove or a hole.

* * * * *

UNITED STATES PATENT AND TRADEMARK OFFICE

CERTIFICATE OF CORRECTION

PATENT NO. : 7,004,734 B2 
DATED : February 28, 2006
INVENTOR(S) : Ryosuke Izawa et al.

It is certified that error appears in the above-identified patent and that said Letters Patent is hereby corrected as shown below:

Title page,
Item [73], should read:
-- [73] Assignee: Zexel Valeo Climate Control Corporation, Saitama (JP) --.

Signed and Sealed this

Eighteenth Day of April, 2006

JON W. DUDAS
*Director of the United States Patent and Trademark Office*